United States Patent [19]

Tracey

[11] Patent Number: 4,754,107

[45] Date of Patent: Jun. 28, 1988

[54] REMOTELY OPERABLE MASTER AND SLAVE SWITCH

[75] Inventor: Peter M. Tracey, Bury St. Edmonds, Great Britain

[73] Assignee: Bestquint Ltd., Suffolk, Great Britain

[21] Appl. No.: 910,936

[22] Filed: Sep. 24, 1986

[30] Foreign Application Priority Data

Sep. 27, 1985 [GB] United Kingdom ..... 8523923

[51] Int. Cl.[4] ..... H01H 35/34

[52] U.S. Cl. ..... 200/83 P; 200/81 H; 200/83 Z

[58] Field of Search ..... 92/5 R, 36; 91/1; 340/626; 73/701, 714, 715, 716, 717, 723; 200/81 R, 81 H , 81.5, 83 R, 83 N, 83 P, 83 C, 83 D, 83 S, 83 T, 83 Y, 83 Z

[56] References Cited

U.S. PATENT DOCUMENTS

| | | | |
|---|---|---|---|
| 2,698,887 | 1/1955 | Shaw | 200/83 W |
| 3,553,402 | 1/1971 | Hire | 200/83 P |
| 4,636,598 | 1/1987 | Suzuki | 200/83 N |

FOREIGN PATENT DOCUMENTS

| | | | |
|---|---|---|---|
| 1299432 | 12/1972 | United Kingdom | 200/81 H |
| 1468521 | 3/1977 | United Kingdom . | |

*Primary Examiner*—G. P. Tolin

*Attorney, Agent, or Firm*—Burgess, Ryan & Wayne

[57] ABSTRACT

A remotely operable switching arrangement comprises a master and slave providing variable volume chambers in air communication with each other. A switch is operably connected to the slave so that variation in the volume of the master chamber causes switching of the switch between two states. The arrangement is such that the switch is stable in only one of the states. Preferably the master, or alternatively the slave, includes a means to provide a snap-action upon switching from one of the states to the other.

10 Claims, 2 Drawing Sheets

REMOTELY OPERABLE MASTER AND SLAVE SWITCH

FIELD OF THE INVENTION

This invention relates to remotely operable arrangements, and in particular, but not exclusively, to remotely operable switching arrangements of the type comprising a master and a slave providing variable volume master and slave chambers, respectively, in air communication with each other, and a switch operably connected to the slave so that variation in the volume of the master chamber causes switching of the switch between two states, the arrangement being such that the switch is stable in only one of the states and such as to cause a snap-action upon switching from at least one of the states to the other. The snap-action is provided to cause a rapid and clean make, break and/or changeover of the switch.

BACKGROUND ART

Such an arrangement is known in which the switch is a snap-action mono-stable microswitch. A disadvantage of such an arrangement is that some microswitches are relatively expensive, and despite their name, their overall size is relatively large.

A further disadvantage of the known arrangement is that the air dampens the feedback to the master of the snap-action of the microswitch. It has been found desirable to provide some feel or tactility to the arrangement in the case where it is to be manually operated.

SUMMARY OF THE INVENTION

In accordance with the present invention, the snap-action of the arrangement is provided by the master device and/or the slave device. Thus, the invention enables a very basic and cheap switch to be used.

In accordance with a preferred feature of the present invention, the snap-action is provided by the master. In addition to providing a good feel to the arrangement, this feature causes, in response to a progressively applied force to the master, a more squared-up pulse of air to be transmitted from the master to the slave. In some cases, it is desirable to provide a bleed in the pneumatic system, but even with such a bleed, the squared-up air pulse causes proper operation of the switch.

The arrangement described above may be used to operate means other than a switch, for example a light shutter, and a working fluid other than air may be used.

The present invention is also concerned with the master device and slave device, per se, and in accordance with a further aspect of the invention there is provided a master or slave device for a remotely operable arrangement, the device providing a variable volume chamber adapted to be connected in fluid communication with a slave or master device, and the chamber having a wall which can be moved to vary the volume of the chamber, the device including means to cause a snap-action of the wall upon such movement.

Further features and advantages of the invention will be apparent from the following description given by way of example of specific embodiments of the invention.

BRIEF DESRIPTION OF THE DRAWINGS

DESCRIPTION OF PREFERRED EMBODIMENTS

Figure 1:
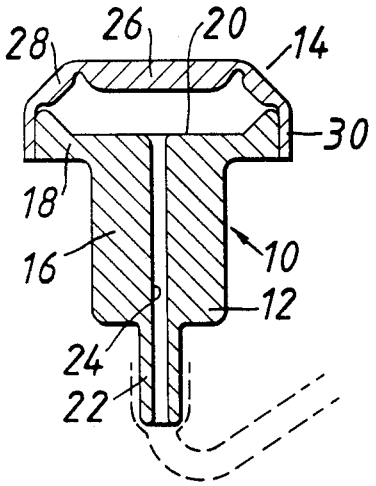
FIG. 1 is a sectional elevation of one embodiment of master device in one state.
Figure 2:
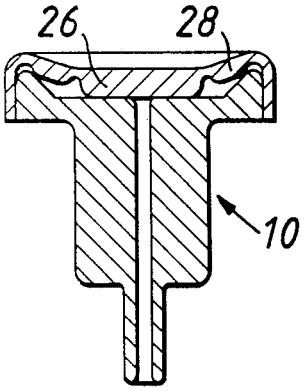
FIG. 2 is a view of the device of FIG. 1 in the other state.

Referring to FIGS. 1 and 2, a master button 10 comprises a base 12 of moulded plastics material and a bellows 14 of flexible plastics, rubber or the like, bonded to the base 12.

The base 12 has a shank 16 with a flanged head 18, the top of the head being formed with a shallow recess 20. The lower end of the shank is formed with a nipple 22, and a passageway 24 extends through the nipple 22 and the shank 16 to the recess 20.

Figure 4:
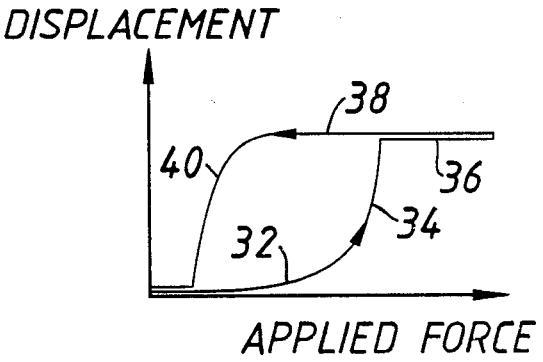
FIG. 4 is a graph schematically illustrating the snap-action of the arrangement.

The bellows 14 has a central portion 26, a downwardly and outwardly inclined frustoconical portion 28 and a cylindrical skirt 30, the cylindrical skirt 30 being bonded to the outer edge of the head 18 of the base 12. The thickness of the bellows 14 is not constant, but, rather, is thinned at the junction of the central portion 26 with the frustoconical portion 28 and at the junction between the frustoconical portion 28 and the skirt 30. This thinning of the bellows causes the material to tend to pivot at those junctions upon downward depression of the central portion 26, and such thinning combined with the resilient nature of the material of the bellows 14 provides a snap-action as the bellows 14 is depressed. The snap-action is illustrated schematically by the graph of FIG. 4. As the force applied to the bellows 14 is progressively increased, initially there is little movement of the bellows, as shown by part 32 of the graph, but as the applied force increases further the bellows moves rapidly with little additional force as shown by part 34 in the graph until the central portion 26 abuts the head 18 of the base 12, whereupon a further increase in the applied force produces no further movement, as shown by part 36 of the graph. If the applied force is subsequently decreased, initially there is little movement of the bellows, as shown by part 38 of the graph, but with further decrease in the applied force the bellows returns fairly swiftly as shown by part 40 of the graph, until the bellows has returned to its initial position.

Figure 3:
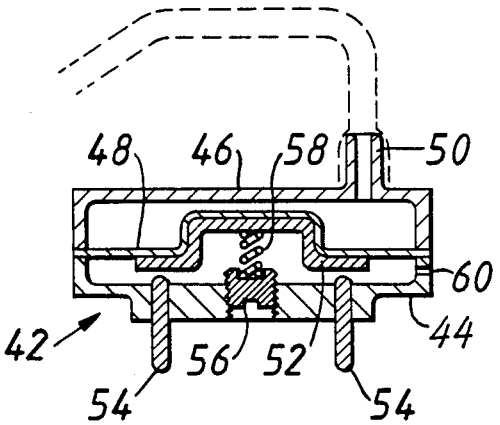
FIG. 3 is a sectional elevation of one embodiment of a slave and switch assembly.

Referring now to FIG. 3 the slave and switch assembly 42 has a housing provided by a lower part 44 and an upper part 46. A top-hat shaped diaphragm 48 extends across the housing, and the lower and upper housing parts 44, 46 are bonded to the edge of the diaphragm 48. The upper housing part 46 is provided with a nipple 50 which is connected to the nipple 22 of the master button 10 by means of a length of flexible tube of small bore. Thus, upon depression of the bellows 14 of the master button 10, the pressure in the connecting tube increases and the diaphragm 48 is deflected downwardly.

A top-hat shaped copper conductor 52 is fitted to the underside of the diaphragm 48 and may be bonded thereto. A pair of terminal pins 54 suitable for connection to a printed circuit board extend through the lower housing part 44 so that upon downward deflection of the diaphragm 48 and conductor 52 the terminal pins are electrically connected. An adjuster screw 56 is mounted in a screw threaded hole in the lower housing part, and a light return spring 58 extends between the adjuster screw and the centre of the copper conductor 52 so as to provide an adjustable return biassing force to the diaphragm.

If desired, a vent hole 60 may be provided in the lower housing part 44. Also, a tiny bleed hole (not shown) may be provided in the upper housing part 46 so that upon operation of the master button 10 the switch will close, but as the air pressure is bled off through the bleed hole the switch will return. Therefore, upon depression of the master button 10, the switch will close for a predetermined period of time. The bleed hole also allows the static pressure in the pneumatic system to equalise with the atmospheric pressure.

Figure 5:
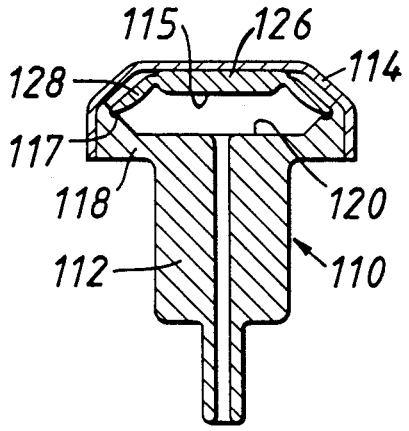
FIGS. 5 and 6 are sectioned elevations of other embodiments of master device.

Referring now to FIG. 5 there is shown a modified master button 110, which is similar in many respects to the master button 10 shown in FIGS. 1 and 2. However, the bellows 114 is of uniform thickness and does not provide the snap-action. Instead, a snap-action element 115 is fitted beneath the bellows 114. The element 115 may be formed of polyethylene, beryllium copper, or any other suitable material. The element 115 has a central portion 126 and a downwardly and outwardly extending frustoconical portion 128, the junction between these two portions being thinned. The edge of the frustoconical portion 128 is fitted into a groove 117 adjacent the lip of a recess 120 provided in the head 118 of the base 112. It will be apparent that the snap-action element 115 and the bellows 114 act in a similar manner to the bellows 14 shown in FIGS. 1 and 2.

Figure 6:
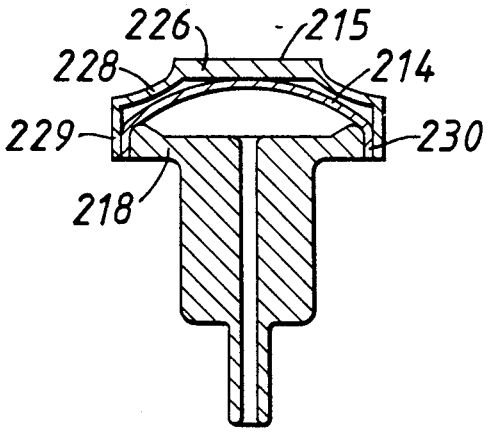

A further modification is shown in FIG. 6. In this case, a snap-action element 215 is provided on the outside of the bellows 214. The bellows 214 has a skirt 230 which is bonded to the peripheral edge of the head 218. The snap-action element 215 has a central portion 226, a thinned, downwardly and outwardly frustoconical portion 228, and a downwardly depending skirt 229 the lower edge of which is bonded to the skirt 230 of the bellows 214.

In order to constrain the bellows of the master button for axial downward movement, a downwardly depending post may be provided on the bellows or the snap-action element, the post being slidable in the passageway 24 through the base of the master button.

It will be appreciated that the snap-action may be provided in the master button by other means. For example, the button may be provided by a piston and cylinder arrangement, the piston skirt having a non-uniform diameter along its length and being engagable with a resilient O-ring located in the wall of the cylinder to provide the snap-action.

If desired, the master button may be provided with other features such as an air bleed valve as illustrated, for example, in FIG. 9 of British Patent Specification GB No. 1,468,521.

What I claim is:

1. A remotely operable switching arrangement comprising master means providing a master chamber, the master chamber having a volume which is manually variable; slave means providing a variable volume slave chamber; means interconnecting said master means and slave means in air communication with each other; switch means having first and second states and within and operably connected to said slave means so that variation in the volume of said master chamber causes switching of the switch between said two states; means to cause the switch to be stable in only one of said states; and snap means in said master means which solely provides a snap-action upon switching from each said state to the other said state.

2. An arrangement as claimed in claim 1, wherein said master means has a flexible wall which can be depressed to vary the volume of said master chamber.

3. An arrangement as claimed in claim 2, wherein an abutment is provided to limit the amount of depression of said flexible wall, the wall being unstable when fully depressed.

4. An arrangement as claimed in claim 2, wherein said snap-action means is provided by the construction of said flexible wall.

5. An arrangement as claimed in claim 2 wherein said snap-action means is provided by an element movable with said flexible wall.

6. An arrangement as claimed in claim 1, wherein said slave means has a flexible wall to permit variation of the volume of said slave chamber.

7. An arrangement as claimed in claim 6, wherein a switch element is mounted on said flexible wall of said slave means.

8. An arrangement as claimed in claim 6, including biassing means to urge said flexible wall to a position corresponding to said one state of the switch.

9. An arrangement as claimed in claim 8, including means for adjusting the amount of bias provided by said biassing means.

10. A remotely operable arrangement comprising master means providing a master chamber, the master chamber having a volume which is manually variable; slave means providing a variable volume slave chamber; means interconnecting said master means and slave means in fluid communication with each other; operable means having first and second states and within and operably connected to said slave means so that variation in the volume of said master chamber causes operation of the operable means between said two states; means to cause said operable means to be stable in only one of said states; and snap means in said master means which solely provides a snap-action upon changing from each said state to the other said state.

* * * * *